US011421375B2

(12) United States Patent
Djerekarov et al.

(10) Patent No.: US 11,421,375 B2
(45) Date of Patent: Aug. 23, 2022

(54) DETECTING DEGREE OF DRYNESS IN A HEAT PUMP LAUNDRY APPLIANCE

(71) Applicant: Haier US Appliance Solutions, Inc., Wilmington, DE (US)

(72) Inventors: Jivko Ognianov Djerekarov, Louisville, KY (US); David Scott Dunn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 197 days.

(21) Appl. No.: 16/798,604

(22) Filed: Feb. 24, 2020

(65) Prior Publication Data

US 2021/0262153 A1 Aug. 26, 2021

(51) Int. Cl.

| | |
|---|---|
| ***F26B 3/32*** | (2006.01) |
| ***D06F 58/38*** | (2020.01) |
| ***D06F 58/20*** | (2006.01) |
| *D06F 103/02* | (2020.01) |
| *D06F 105/30* | (2020.01) |
| *D06F 103/30* | (2020.01) |
| *D06F 105/26* | (2020.01) |
| *D06F 103/32* | (2020.01) |

(52) U.S. Cl.

CPC ..... *D06F 58/38* (2020.02); *D06F 58/206* (2013.01); *D06F 2103/02* (2020.02); *D06F 2103/30* (2020.02); *D06F 2103/32* (2020.02); *D06F 2105/26* (2020.02); *D06F 2105/30* (2020.02)

(58) Field of Classification Search

CPC .... D06F 58/38; D06F 58/206; D06F 2103/02; D06F 2103/30; D06F 2103/32; D06F 2103/50; D06F 2105/26; D06F 2105/30; D06F 2105/58

USPC ..... 34/475

See application file for complete search history.

(56) References Cited

U.S. PATENT DOCUMENTS

| | | | | |
|---|---|---|---|---|
| 7,469,486 | B2 | 12/2008 | Tamura et al. | |
| 2007/0017113 | A1* | 1/2007 | Scharpf | F26B 21/086 34/86 |
| 2007/0107255 | A1 | 5/2007 | Tamura et al. | |
| 2010/0263226 | A1 | 10/2010 | Balerdi Azpilicueta et al. | |
| 2014/0109322 | A1 | 4/2014 | Park et al. | |
| 2014/0202673 | A1* | 7/2014 | Wand | F28D 1/05383 165/175 |
| 2018/0266043 | A1 | 9/2018 | Kim et al. | |
| 2020/0207182 | A1* | 7/2020 | Ishizeki | B60H 1/22 |

FOREIGN PATENT DOCUMENTS

WO WO-2014187494 A1 * 11/2014 ..... D06F 58/206

* cited by examiner

*Primary Examiner* — John P McCormack

(74) *Attorney, Agent, or Firm* — Dority & Manning, P.A.

(57) ABSTRACT

A method of operating a laundry appliance in a drying cycle includes motivating a flow of process air from a drum of the laundry appliance across an evaporator of a sealed system. Refrigerant in the evaporator of the sealed system absorbs heat from the flow of process air and the refrigerant circulates through the sealed system. The method also includes receiving, by a controller of the laundry appliance, an input indicative of a characteristic of the sealed system. The method further includes determining, by the controller, a dryness level of articles in the drum of the laundry appliance based on the received input indicative of the characteristic of the sealed system.

15 Claims, 4 Drawing Sheets

DETECTING DEGREE OF DRYNESS IN A HEAT PUMP LAUNDRY APPLIANCE

FIELD OF THE INVENTION

The present subject matter relates generally to laundry appliances, and more particularly to laundry appliances operable for detecting the degree of dryness of articles therein and related methods.

BACKGROUND OF THE INVENTION

Closed loop airflow circuit laundry appliances can efficiently dry laundry articles. Example closed loop airflow circuit laundry appliances include condenser dryers, heat pump dryers, and spray tower dryer appliances. Such dryer appliances include a closed loop airflow circuit along which process air is moved. The process air is conditioned by a conditioning system, e.g., to remove moisture from the process air after the air has absorbed water from articles and also heats the air to increase the moisture capacity of the air.

For example, a heat pump dryer uses a refrigerant cycle to both provide hot air to the dryer and to condense water vapor in air coming from the dryer. Since the moisture content in the air from the dryer is reduced by condensation over the evaporator, this same air can be reheated again using the condenser and then passed through the dryer again to remove more moisture.

In many dryer appliances (or combination laundry appliances operating in a dry cycle), dry cycles operate for predetermined periods of time. A user may, for example, choose one or more variables, such as dryness level and load size, and a set time period for a dry cycle may be set based on these variables. These predetermined dry cycle time periods, however, can result in over-drying or under-drying of articles being dried, because other variables such as the moisture content of the articles is not taken into account. More recently, attempts have been made to determine appropriate dry cycle time periods for articles in real time during dry cycles, in order to reduce instances of over-drying and under-drying. For example, attempts have been made to measure the resistance across the articles during the dry cycle and correlate these measurements to dryness. Such attempts, however, can be complex and unreliable, and may for example still result in instances of over-drying and under-drying. Further, electrical sensors used to measure the dryness of articles in a dry cycle have some drawbacks. For instance, such specialized sensors may result in undesirable increase in cost and/or complexity of the appliance. As another example, if electrical sensors are provided in a washer-dryer combination laundry appliance, the electrical sensors may be submerged during the wash cycle(s) of the combination appliance, which can be detrimental to the sensors.

Accordingly, improved laundry appliances including features for detecting dryness of articles therein and related methods are desired in the art.

BRIEF DESCRIPTION OF THE INVENTION

Aspects and advantages of the invention will be set forth in part in the following description, or may be obvious from the description, or may be learned through practice of the invention.

In one aspect, a method of operating a laundry appliance in a drying cycle is provided. The method includes motivating a flow of process air from a drum of the laundry appliance across an evaporator of a sealed system. Refrigerant in the evaporator of the sealed system absorbs heat from the flow of process air and the refrigerant circulates through the sealed system. The method also includes receiving, by a controller of the laundry appliance, an input indicative of a characteristic of the sealed system. The method further includes determining, by the controller, a dryness level of articles in the drum of the laundry appliance based on the received input indicative of the characteristic of the sealed system.

In another aspect, a laundry appliance is provided. The laundry appliance includes a cabinet and a drum rotatably mounted within the cabinet. The drum defines a chamber for receipt of articles for drying. The drum also defines a drum outlet and a drum inlet to the chamber. The laundry appliance further includes a sealed system configured to heat and remove moisture from process air flowing therethrough. The laundry appliance also includes a duct system for providing fluid communication between the drum outlet and the sealed system and between the sealed system and the drum inlet. The duct system, the sealed system, and the drum define a process air flow path. The laundry appliance further includes a blower fan operable to move process air along the process air flow path and a controller. The controller is configured for activating the blower fan to motivate a flow of process air along the process air flow path and across an evaporator of the sealed system, which causes refrigerant in the evaporator of the sealed system to absorb heat from the flow of process air and the refrigerant to circulate through the sealed system. The controller is also configured for receiving an input indicative of a characteristic of the sealed system and determining a dryness level of articles in the chamber of the drum of the laundry appliance based on the received input indicative of the characteristic of the sealed system.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
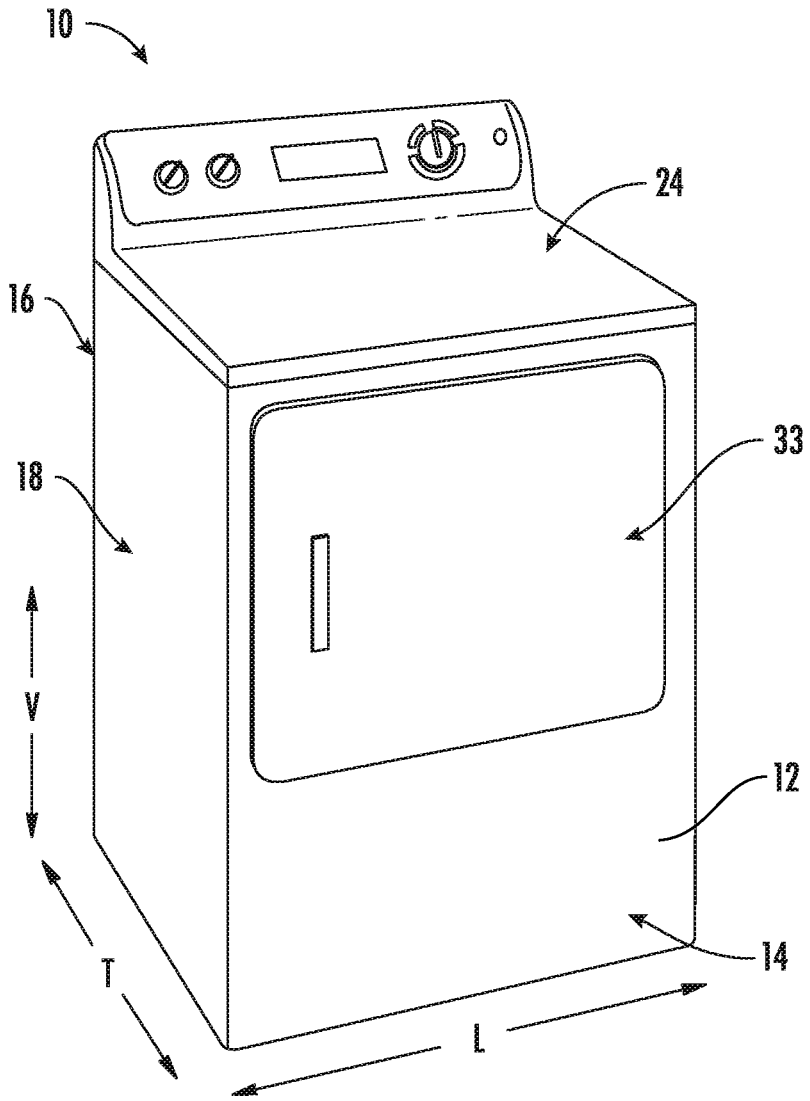
FIG. 1 provides a perspective view of a laundry appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
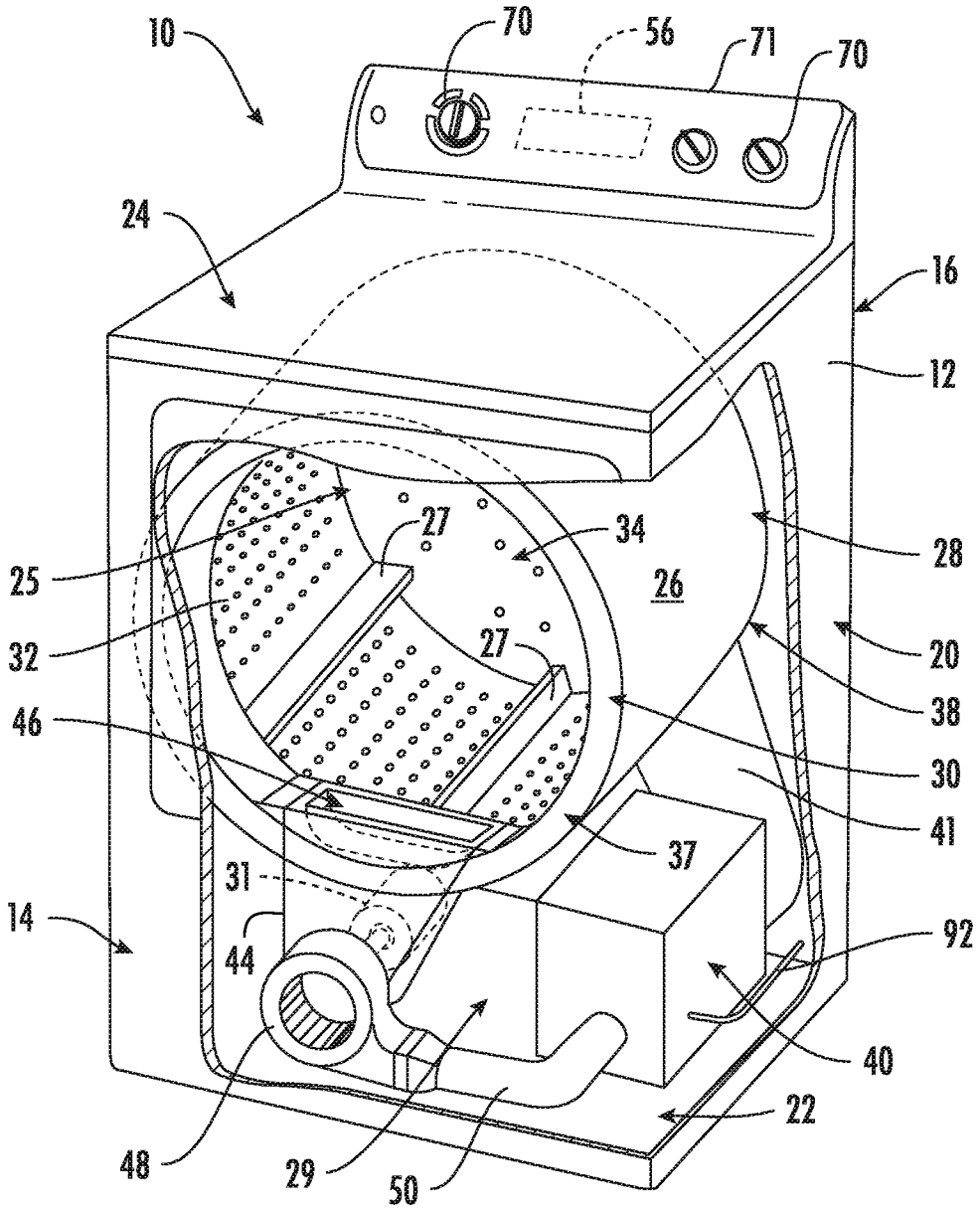
FIG. 2 provides a perspective view of the example laundry appliance of FIG. 1 with portions of a cabinet of the laundry appliance removed to reveal certain components of the laundry appliance.

FIGS. 1 and 2 provide perspective views of a laundry appliance 10 according to exemplary embodiments of the present disclosure. Laundry appliance 10 is a dryer appliance in the illustrated embodiments and may also, in additional embodiments, include features for washing articles, e.g., the laundry appliance 10 may also or instead be a combination laundry appliance. In particular, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other laundry appliances having different appearances and different features may also be utilized with the present subject matter as well. For instance, in some embodiments, laundry appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum or container 26 is mounted for rotation about a substantially horizontal axis within the interior volume 29 of cabinet 12. Drum 26 defines a chamber 25 for receipt of articles for tumbling and/or drying. Drum 26 extends between a front portion 37 and a back portion 38, e.g., along the transverse direction T. Drum 26 also includes a back or rear wall 34, e.g., at back portion 38 of drum 26. A supply duct 41 may be mounted to rear wall 34. Supply duct 41 receives heated air that has been heated by a conditioning system 40 and provides the heated air to drum 26 via one or more holes defined in rear wall 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes that receive hot air that has been heated by a conditioning system 40, e.g., a heat pump or refrigerant-based conditioning system as will be described further below. Moisture laden, heated air is drawn from drum 26 by an air handler, such as a blower fan 48, which generates a negative air pressure within drum 26. The moisture laden heated air passes through a duct 44 enclosing screen filter 46, which traps lint particles. As the air passes from blower fan 48, it enters a duct 50 and then is passed into conditioning system 40. In some embodiments, dryer appliance 10 is a heat pump dryer appliance and thus conditioning system 40 may be or include a heat pump including a sealed refrigerant circuit, as described in more detail below with reference to FIG. 3. Heated air (with a lower moisture content than was received from drum 26), exits conditioning system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) a processing device or controller 56. Controller 56 may also be communicatively coupled with various operational components of dryer appliance 10, such as motor 31, blower 48, and/or components of conditioning system 40. In turn, signals generated in controller 56 direct operation of motor 31, blower 48, or conditioning system 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

Figure 3:
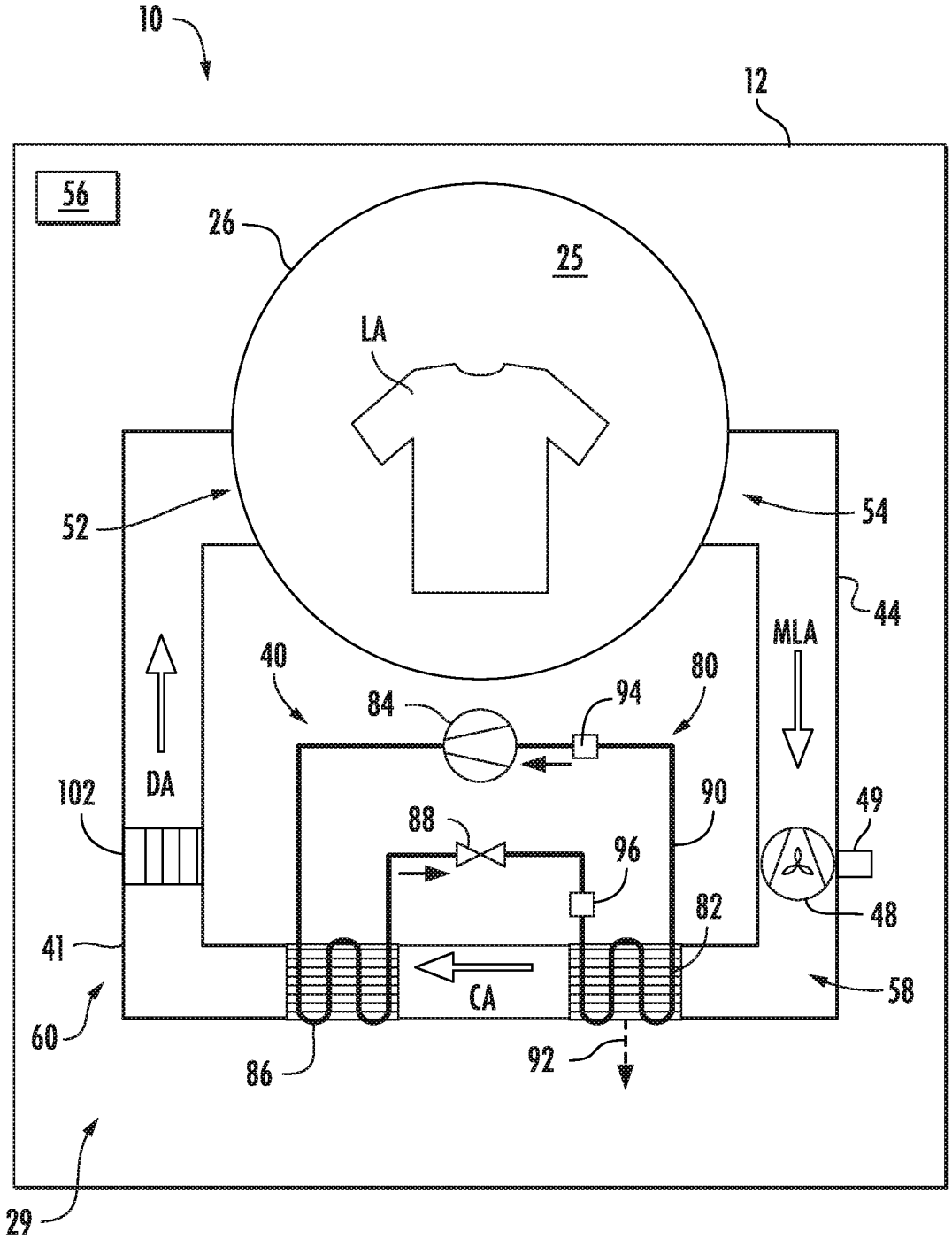
FIG. 3 provides a schematic diagram of an exemplary heat pump laundry appliance and a conditioning system thereof in accordance with exemplary embodiments of the present disclosure.

FIG. 3 provides a schematic view of laundry appliance 10 and depicts conditioning system 40 in more detail. For this embodiment, laundry appliance 10 is a heat pump dryer appliance and thus conditioning system 40 includes a sealed system 80. In additional embodiments, the conditioning system 40 illustrated in FIG. 3 and described herein may also be provided in, for example, a combination washing machine/dryer appliance. Sealed system 80 includes various operational components, which can be encased or located within a machinery compartment of dryer appliance 10.

Generally, the operational components are operable to execute a vapor compression cycle for heating process air passing through conditioning system 40. The operational components of sealed system 80 include an evaporator 82, a compressor 84, a condenser 86, and one or more expansion devices 88 connected in series along a refrigerant circuit or line 90. In the illustrated embodiments, the expansion device 88 is an expansion valve, such as an electronic expansion valve. Refrigerant line 90 is charged with a working fluid, which in this example is a refrigerant. Sealed system 80 depicted in FIG. 3 is provided by way of example only. Thus, it is within the scope of the present subject matter for other configurations of the sealed system to be used as well. For example, in some embodiments, the expansion device 88 may also or instead include a capillary tube. As will be understood by those skilled in the art, sealed system 80 may include additional components, e.g., at least one additional evaporator, compressor, expansion device, and/or condenser. As an example, sealed system 80 may include two (2) evaporators.

In some embodiments, the sealed system 80 may optionally include one or more sensors for measuring characteristics of the sealed system 80. For example, the sealed system 80 may include a suction line temperature sensor 94, e.g., upstream of the compressor 84. As another example, the sealed system 80 may include an evaporator inlet temperature sensor 96 positioned at an inlet of the evaporator 92 and configured to measure a temperature of the refrigerant at the inlet of the evaporator 92.

In performing a drying and/or tumbling cycle, one or more laundry articles LA may be placed within the chamber 25 of drum 26. Hot dry air DA is supplied to chamber 25 via duct 41. The hot dry air DA enters chamber 25 of drum via a drum inlet 52 defined by drum 26, e.g., the plurality of holes defined in rear wall 34 of drum 26 as shown in FIG. 2. The hot dry air DA provided to chamber 25 causes moisture within laundry articles LA to evaporate. Accordingly, the air within chamber 25 increases in water content and exits chamber 25 as warm moisture laden air MLA. The warm moisture laden air MLA exits chamber 25 through a drum outlet 54 defined by drum 26 and flows into duct 44.

After exiting chamber 25 of drum 26, the warm moisture laden air MLA flows downstream to conditioning system 40. Blower fan 48 moves the warm moisture laden air MLA, as well as the air more generally, through a process air flow path 58 defined by drum 26, conditioning system 40, and the duct system 60. Thus, generally, blower fan 48 is operable to move air through or along the process air flow path 58. Duct system 60 includes all ducts that provide fluid communication (e.g., airflow communication) between drum outlet 54 and conditioning system 40 and between conditioning system 40 and drum inlet 52. Although blower fan 48 is shown positioned between drum 26 and conditioning system 40 along duct 44, it will be appreciated that blower fan 48 can be positioned in other suitable positions or locations along duct system 60.

As further depicted in FIG. 3, the warm moisture laden air MLA flows into or across evaporator 82 of the conditioning system 40. As the moisture laden air MLA passes across evaporator 82, the temperature of the air is reduced through heat exchange with refrigerant that is vaporized within, for example, coils or tubing of evaporator 82. This vaporization process absorbs both the sensible and the latent heat from the moisture laden air MLA—thereby reducing its temperature. As a result, moisture in the air is condensed and such condensate water may be drained from conditioning system 40, e.g., using a drain line 92, which is also depicted in FIG. 2.

Air passing over evaporator 82 becomes cooler than when it exited drum 26 at drum outlet 54. As shown in FIG. 3, cool air CA (cool relative to hot dry air DA and moisture laden air MLA) flowing downstream of evaporator 82 is subsequently caused to flow across condenser 86, e.g., across coils or tubing thereof, which condenses refrigerant therein. The refrigerant enters condenser 86 in a gaseous state at a relatively high temperature compared to the cool air CA from evaporator 82. As a result, heat energy is transferred to the cool air CA at the condenser 86, thereby elevating its temperature and providing warm dry air DA for resupply to drum 26 of dryer appliance 10. The warm dry air DA passes over and around laundry articles LA within the chamber 25 of the drum 26, such that warm moisture laden air MLA is generated, as mentioned above. Because the air is recycled through drum 26 and conditioning system 40, dryer appliance 10 can have a much greater efficiency than traditional clothes dryers can where all of the warm, moisture laden air MLA is exhausted to the environment.

In some embodiments, conditioning system 40 of dryer appliance 10 optionally includes an electric heater 102 positioned to provide heat to process air flowing along the process air flow path 58, e.g., as shown in FIG. 3. Electrical heater 102 can receive electrical power (e.g., from a power source) and can generate heat based at least in part on the received electrical power. The generated heat can be imparted to the process air flowing along the process air flow path 58.

With respect to sealed system 80, compressor 84 pressurizes refrigerant (i.e., increases the pressure of the refrigerant) passing therethrough and generally motivates refrigerant through the sealed refrigerant circuit or refrigerant line 90 of conditioning system 40. Compressor 84 may be communicatively coupled with controller 56 (communication lines not shown in FIG. 3). Refrigerant is supplied from the evaporator 82 to compressor 84 in a low pressure gas phase. The pressurization of the refrigerant within compressor 84 increases the temperature of the refrigerant. The compressed refrigerant is fed from compressor 84 to condenser 86 through refrigerant line 90. As the relatively cool air CA from evaporator 82 flows across condenser 86, the refrigerant is cooled and its temperature is lowered as heat is transferred to the air for supply to chamber 25 of drum 26.

Upon exiting condenser 86, the refrigerant is fed through refrigerant line 90 to expansion valve 88. Expansion valve 88 lowers the pressure of the refrigerant and controls the amount of refrigerant that is allowed to enter the evaporator 82. The flow of liquid refrigerant into evaporator 82 is limited by expansion valve 88 in order to keep the pressure low and allow expansion of the refrigerant back into the gas phase in evaporator 82. The evaporation of the refrigerant in evaporator 82 converts the refrigerant from its liquid-dominated phase to a gas phase while cooling and drying the moisture laden air MLA received from chamber 25 of drum 26. The process is repeated as air is circulated along process air flow path 58 while the refrigerant is cycled through sealed system 80, as described above.

Although dryer appliance 10 is depicted and described herein as a heat pump dryer appliance, in at least some embodiments, dryer appliance 10 can be a combination washer/dryer appliance.

Dryness of the laundry articles LA may be detected based on one or more parameters of the sealed system 80. For example, such parameters may include temperature, pressure, and/or superheat. Over the course of the drying cycle or operation, as the moisture content in the laundry articles LA decreases, i.e., when the laundry articles LA are dry or nearly dry, the capacity of the moisture laden air MLA to transfer heat to the refrigerant in the evaporator decreases. More particularly, as the remaining moisture content in the laundry articles LA decreases, the humidity and latent heat of the moisture laden air MLA decreases. Thus, when there is less latent heat in the MLA for the vaporization process to absorb, the refrigerant may transition from liquid phase to vapor phase more slowly and/or incompletely. For example, this may result in a reduction in the degree of superheat in the refrigerant system, whereby the refrigerant remains in a liquid phase for a longer time. For example, liquid refrigerant may be present at the end of the evaporator coil 82 when the moisture laden air MLA is relatively (e.g., as compared to earlier in the dry cycle) less humid. Those of ordinary skill in the art will recognize that the degree of superheat refers to the extent to which the vaporized refrigerant exceeds the boiling point of the refrigerant. Thus, when the refrigerant in the evaporator absorbs less heat from the moisture laden air MLA, e.g., when there is less latent heat in the moisture laden air MLA because there is less moisture in the laundry articles LA, the degree of superheat in the sealed system 80, and in particular at or around the evaporator 82, such as at the evaporator inlet and/or in the suction line between the evaporator 82 and the compressor 84, will be less than the degree of superheat in the sealed system 80 when the moisture laden air MLA is relatively high (e.g., earlier in the dry cycle, when the remaining moisture content of the laundry articles is high). Accordingly, when the superheat in the sealed system 80 is relatively low, e.g., is at a low point relative to other times during the dry cycle, it may be inferred or determined that the remaining moisture content of the laundry articles LA is also at a low point, i.e., that the laundry articles LA are dry.

The electronic expansion valve 88 is operable to adjust a pressure of the refrigerant flowing along sealed system 80. For example, controller 56 may be configured to cause the electronic expansion valve 88 to adjust the pressure of the refrigerant flowing along the sealed system 80. For instance, the electronic expansion valve 88 can be moved from a first position to a second position which is a closed position or an intermediate position (e.g., not fully open or fully closed) which is closer to the closed position than the first position. This can increase the pressure on the high side of sealed system 80 and decrease the pressure on the low side of sealed system 80. Accordingly, the temperature of the refrigerant increases on the high side of sealed system 80 and the temperature of the refrigerant decreases on the low side of sealed system 80. That is, adjustment of the electronic expansion valve can drive higher temperatures in condenser 86 and can lower the temperature of the evaporator 82. Further, adjustment of the electronic expansion valve 88 can maintain a constant superheat in the sealed system 80 and in particular a constant level of superheat into the compressor 84, such as to avoid liquid refrigerant reaching the compressor 84. For example, the controller 56 may be configured to automatically adjust the electronic expansion valve 88 to maintain a constant degree of superheat into the compressor 84. As the degree of superheat in the sealed system 80 decreases, e.g., when the remaining moisture content in the laundry articles LA is below a certain level or threshold, the electronic expansion valve 88 may be closed (or partially closed, e.g., moved to an intermediate position which is closer to the closed position than a prior position) to restrict the flow of refrigerant in the sealed system 80. Thus, in some embodiments, the degree of superheat in the sealed system 80 and therefore the dryness of the laundry articles LA may be determined based on the position of the electronic expansion valve 88. For example, the laundry appliance 10 may include a position sensor or other expansion valve position tracking system which may be used to determine the position of the electronic expansion valve 88 and thereby determine or detect dryness of the laundry articles LA based on the position of the electronic expansion valve 88.

Figure 4:
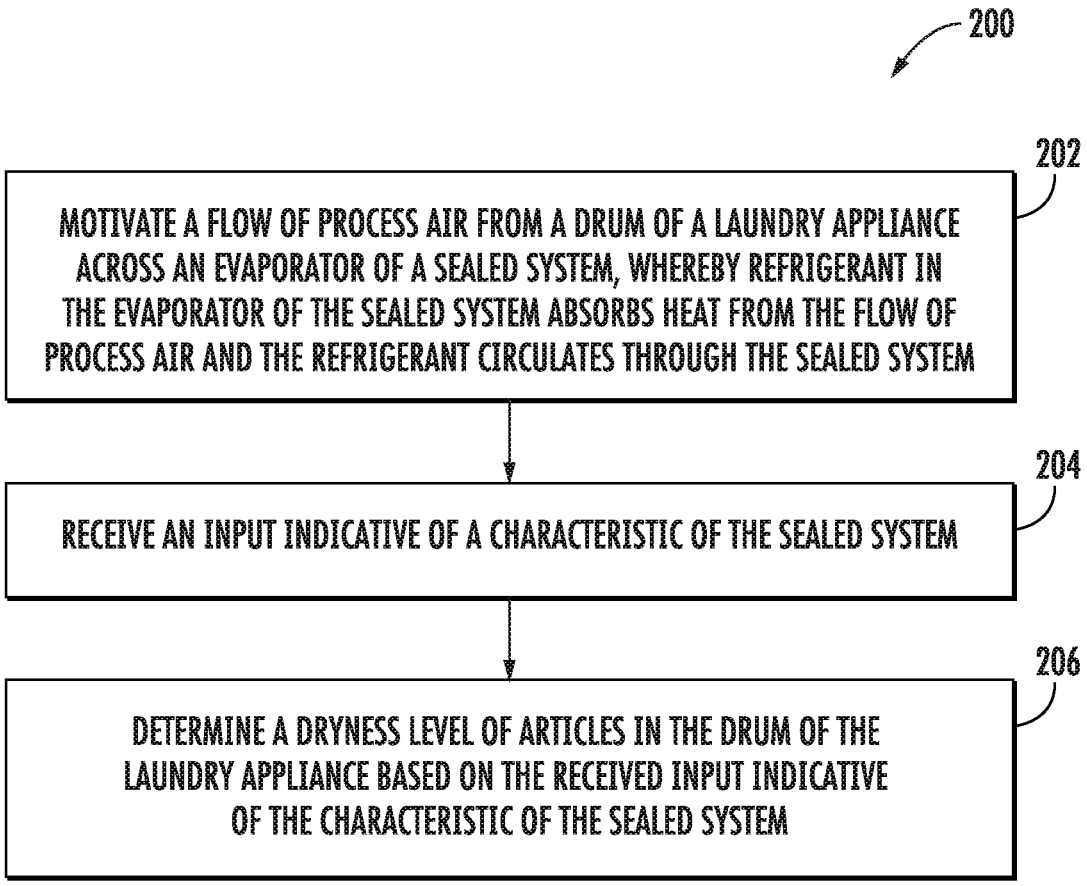
FIG. 4 provides a flow chart of an exemplary method of operating a laundry appliance in a drying cycle according to one or more embodiments of the present disclosure.

FIG. 4 provides a flow diagram of an example method 200 of operating a laundry appliance in a drying cycle. For instance, the dryer appliance 10 described herein can be operated as set forth in method 200. FIG. 4 depicts steps performed in a particular order for purposes of illustration and discussion. Those of ordinary skill in the art, using the disclosures provided herein, will understand that various steps of any of the methods disclosed herein can be modified in various ways without deviating from the scope of the present disclosure.

At 202, the method 200 includes motivating a flow of process air from a drum of the laundry appliance across an evaporator of a sealed system. This may cause refrigerant in the evaporator of the sealed system to absorb heat from the flow of process air. The refrigerant then circulates through the sealed system.

At 204, the method 200 includes receiving an input indicative of a characteristic of the sealed system. For example, the input may be received by a controller of the laundry appliance. In some embodiments, the characteristic of the sealed system may be a degree of superheat in the sealed system. In various embodiments, the input indicative of the degree of superheat in the sealed system may correspond to a position of an expansion valve of the sealed system, a measured temperature in the sealed system, and/or a measured pressure in the sealed system.

At 206, the method 200 includes determining a dryness level of articles in the drum of the laundry appliance based on the received input indicative of the characteristic of the sealed system. For example, the dryness of the articles may be determined or detected by the controller of the laundry appliance.

In some embodiments, the method 200 may further include deactivating the laundry appliance and/or terminating a dry cycle of the laundry appliance based on the determined or detected dryness of the articles. For example, the method 200 may include activating a blower fan of the laundry appliance, such as by the controller, to motivate the flow of process air across the evaporator. In such embodiments, the method 200 may further include deactivating the blower fan, such as by the controller 56, when the determined dryness level is greater than a threshold level. Method 200 may also or instead include deactivating the compressor 84, such as by the controller 56, when the determined dryness level is greater than a threshold level. The laundry appliance may also or instead be deactivated and/or the dry cycle terminated when the superheat in the sealed system is less than a threshold level. Further, the dry cycle may also include, at least during part of the dry cycle, one or more of rotating the drum and activating a heat source (such as the electric heater 102 illustrated in FIG. 3). In such embodiments, deactivation of the laundry appliance and/or termination of the dry cycle may also include stopping rotation of the drum, e.g., deactivating a motor such as the motor 31 illustrated in FIG. 2, and/or deactivating the heat source.

As mentioned above, in some embodiments, the input indicative of the degree of superheat in the sealed system may correspond to a measured temperature in the sealed system. In such embodiments, the measured temperature may be measured in a suction line of the sealed system upstream of a compressor of the sealed system, such as by temperature sensor 94 (FIG. 3), and/or may be measured at an inlet of the evaporator, such as by temperature sensor 96 (FIG. 3).

As mentioned above, in some embodiments, the input indicative of the degree of superheat in the sealed system may correspond to a measured pressure in the sealed system. For example, the input indicative of the degree of superheat in the sealed system may correspond to one or more measured pressures, such as pressures measured at a high side and/or a low side of the sealed system. In some embodiments, the input indicative of the degree of superheat in the sealed system may correspond to a pressure ratio of a first pressure measured at the high side of the sealed system and a second pressure measured at the low side of the sealed system.

Although specific features of various embodiments may be shown in some drawings and not in others, this is for convenience only. In accordance with the principles of the present disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry appliance in a drying cycle, the method comprising:

motivating a flow of process air from a drum of the laundry appliance across an evaporator of a sealed system, whereby refrigerant in the evaporator of the sealed system absorbs heat from the flow of process air and the refrigerant circulates through the sealed system;

receiving, by a controller of the laundry appliance, an input indicative of a characteristic of the sealed system, wherein the characteristic of the sealed system is a degree of superheat in the sealed system and corresponds to a pressure ratio of a first pressure measured at a high side of the sealed system and a second pressure measured at a low side of the sealed system; and determining, by the controller, a dryness level of articles in the drum of the laundry appliance based on the received input indicative of the characteristic of the sealed system.

2. The method of claim 1, wherein the input indicative of the degree of superheat in the sealed system corresponds to a position of an expansion valve of the sealed system.

3. The method of claim 1, wherein the input indicative of the degree of superheat in the sealed system corresponds to a measured temperature in the sealed system.

4. The method of claim 3, wherein the measured temperature is measured in a suction line of the sealed system upstream of a compressor of the sealed system.

5. The method of claim 3, wherein the measured temperature is measured at an inlet of the evaporator.

6. The method of claim 1, wherein the input indicative of the degree of superheat in the sealed system corresponds to a measured pressure in the sealed system.

7. The method of claim 1, wherein motivating the flow of process air comprises activating, by the controller, a blower fan of the laundry appliance.

8. The method of claim 7, further comprising deactivating, by the controller, the blower fan, when the determined dryness level is greater than a threshold level.

9. A laundry appliance, comprising:

a cabinet;

a drum rotatably mounted within the cabinet, the drum defining a chamber for receipt of articles for drying, the drum defining a drum outlet and a drum inlet to the chamber;

a sealed system configured to heat and remove moisture from process air flowing therethrough;

a duct system for providing fluid communication between the drum outlet and the sealed system and between the sealed system and the drum inlet, the duct system, the sealed system, and the drum defining a process air flow path;

a blower fan operable to move process air along the process air flow path; and a controller, the controller configured for:

activating the blower fan to motivate a flow of process air along the process air flow path and across an evaporator of the sealed system, whereby refrigerant in the evaporator of the sealed system absorbs heat from the flow of process air and the refrigerant circulates through the sealed system;

receiving an input indicative of a characteristic of the sealed system, wherein the characteristic of the sealed system is a degree of superheat in the sealed system and corresponds to a pressure ratio of a first pressure measured at a high side of the sealed system and a second pressure measured at a low side of the sealed system; and determining a dryness level of articles in the chamber of the drum of the laundry appliance based on the received input indicative of the characteristic of the sealed system.

10. The laundry appliance of claim 9, wherein the input indicative of the degree of superheat in the sealed system corresponds to a position of an expansion valve of the sealed system.

11. The laundry appliance of claim 9, wherein the input indicative of the degree of superheat in the sealed system corresponds to a measured temperature in the sealed system.

12. The laundry appliance of claim 11, wherein the measured temperature is measured in a suction line of the sealed system upstream of a compressor of the sealed system.

13. The laundry appliance of claim 11, wherein the measured temperature is measured at an inlet of the evaporator.

14. The laundry appliance of claim 9, wherein the input indicative of the degree of superheat in the sealed system corresponds to a measured pressure in the sealed system.

15. The laundry appliance of claim 9, wherein the controller is further configured for deactivating the blower fan when the determined dryness level is greater than a threshold level.

* * * * *